US006588876B2

(12) United States Patent
Taylor et al.

(10) Patent No.: US 6,588,876 B2
(45) Date of Patent: Jul. 8, 2003

(54) INTEGRATED TRANSLATIONAL SERVICE STATION FOR INKJET PRINTHEADS

(75) Inventors: Bret Taylor, Vancouver, WA (US); John D. Rhodes, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/969,684

(22) Filed: Oct. 2, 2001

(65) Prior Publication Data

US 2002/0015070 A1 Feb. 7, 2002

Related U.S. Application Data

(63) Continuation of application No. 09/589,530, filed on Jun. 7, 2000, which is a continuation-in-part of application No. 08/667,611, filed on Jul. 3, 1996, now Pat. No. 6,132,026, which is a continuation-in-part of application No. 08/509,070, filed on Jul. 31, 1995, now abandoned.

(51) Int. Cl.[7] ..... B41J 2/165
(52) U.S. Cl. ..... 347/32; 347/31; 347/33
(58) Field of Search ..... 347/22, 29, 32, 347/33, 35, 31

(56) References Cited

U.S. PATENT DOCUMENTS

| | | | |
|---|---|---|---|
| 4,543,589 | A | 9/1985 | Terasawa |
| 4,937,595 | A | 6/1990 | Midorikawa |
| 5,081,472 | A | 1/1992 | Fisher |
| 5,097,276 | A | 3/1992 | Midorikawa |
| 5,155,497 | A | 10/1992 | Martin et al. |
| 5,260,724 | A | 11/1993 | Tomii et al. |
| 5,467,114 | A | 11/1995 | Ebinuma et al. |
| 5,614,930 | A | 3/1997 | Osborne et al. |
| 5,635,965 | A | 6/1997 | Purwins et al. |
| 5,712,668 | A | 1/1998 | Osborne et al. |
| 5,714,991 | A | 2/1998 | Osborne et al. |
| 5,757,395 | A | 5/1998 | Chew et al. |
| 5,980,018 | A | 11/1999 | Taylor et al. |

FOREIGN PATENT DOCUMENTS

| | | |
|---|---|---|
| EP | 0446885 | 9/1991 |
| EP | 0597677 | 5/1994 |
| EP | 0630753 | 12/1994 |
| JP | 59209876 | 11/1984 |
| JP | 02003324 | 1/1990 |
| JP | 06143597 | 5/1994 |

*Primary Examiner*—Huan Tran

(57) ABSTRACT

An inkjet printhead servicing station for an inkjet printing mechanism includes a translational pallet that carries servicing appliances, like wipers, caps and flaps. A service station frame defines a guide track that supports the pallet for translational movement in a plane substantially parallel with a printhead plane and in a direction substantially perpendicular to the scanning axis of the printhead when transported by a carriage. The frame has adjacent pallet and carriage alignment datums. The pallet has a carriage lock that secures the carriage with or without the inkjet printhead installed therein. The pallet has a rack gear that is driven with a spindle pinion gear. The service station frame has a base and a bonnet cover that define the guide track, with the pallet being sandwiched therebetween. An inkjet printing mechanism having such a service station, and a method of assembling a service station are also provided.

30 Claims, 8 Drawing Sheets

FIG. 4
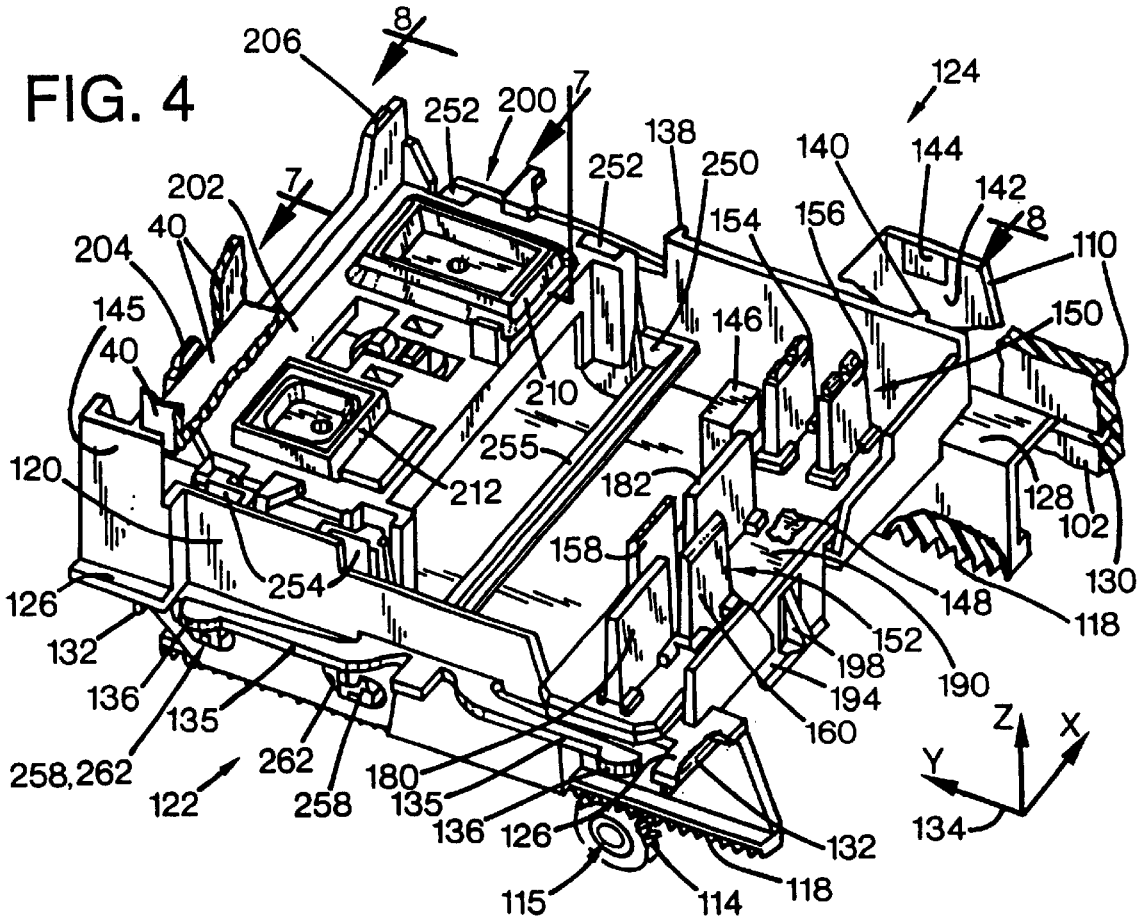
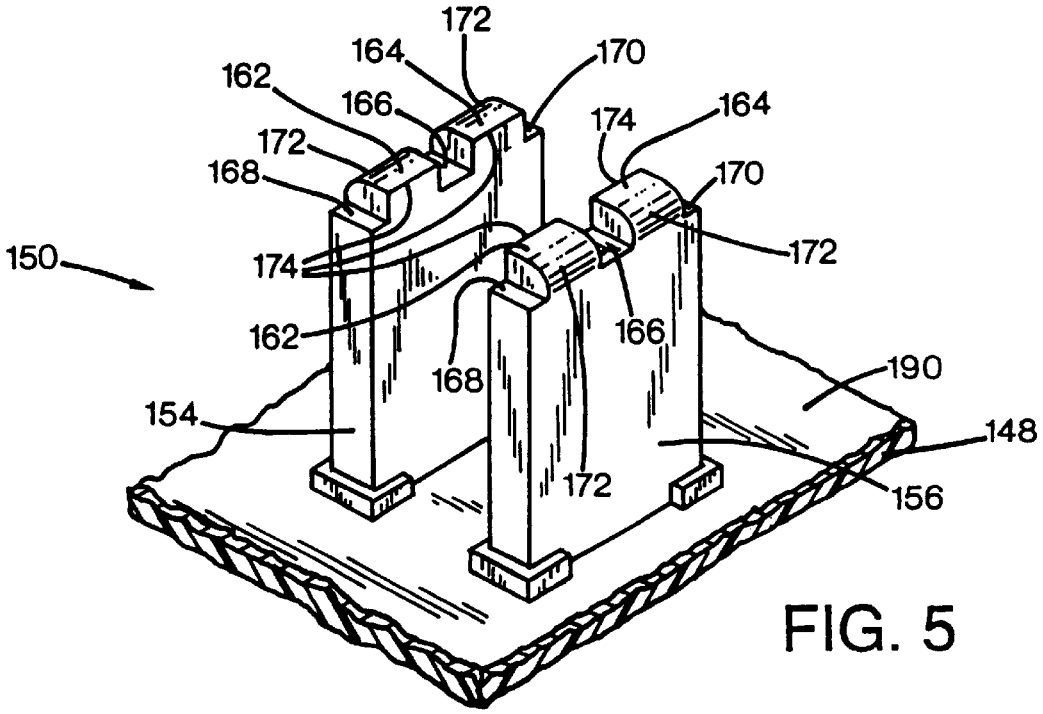
FIG. 5

INTEGRATED TRANSLATIONAL SERVICE STATION FOR INKJET PRINTHEADS

CROSS REFERENCE TO RELATED APPLICATION(S)

This is a continuation of copending application Ser. No. 09/589,530 filed on Jun. 7, 2000, which is a continuation-in-part ("CIP") application of U.S. patent application Ser. No. 08/667,611, filed on Jul. 3, 1996, now U.S. Pat. No. 6,132,026, which is a CIP application of U.S. patent application Ser. No. 08/509,070, filed on Jul. 31, 1995, now abandoned, all having at least one co-inventor in common.

FIELD OF THE INVENTION

The present invention relates generally to inkjet printing mechanisms, and more particularly to a translational printhead servicing station and method for maintaining inkjet printhead health.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper. Unfortunately, the combination of small nozzles and quick-drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, spitting to clear the nozzles becomes even more important when using pigment-based inks, because the higher solids content contributes to the clogging problem more than the earlier dye-based inks.

In previous technology spittoons, most of the spit ink landed in the bottom of the spittoon. Some of the ink, however, ran down the walls of the spittoon tube or "chimney" under the force of gravity and into a reservoir, where many solvents evaporated. Sometimes the waste ink solidified before reaching the reservoir, forming stalagmites from ink deposits along the sides of the chimney. These ink stalagmites often grew and clogged the entrance to the spittoon. To avoid this phenomenon, conventional spittoons must be wide, often over 8 mm in width to handle a high solid-content ink. Since the conventional spittoons were located between the printzone and the other servicing components, this extra width increased the overall printer width, resulting in additional cost being added to the printer, in material, and shipping costs. Moreover, this greater printer width increased the overall printer size, yielding a larger "footprint," that is, a larger working space required to receive the printing mechanism, which was undesirable to many consumers.

As mentioned above, conventional spittoons were located between the printzone and the other servicing components, and to minimize the impact on printer width, the conventional spittoons were only wide enough to receive ink from one printhead at a time. Thus, the conventional spitting routine of a multi-pen unit first positioned one printhead over the spittoon for spitting, then the pen carriage moved the next pen over the spittoon for spitting, etc. Unfortunately, all this carriage motion not only slowed the spitting routine, but it was also noisy Besides increasing the solid content, mutually-precipitating inks have been developed to enhance color contrasts. For example, one type of color ink causes black ink to precipitate out of solution. This precipitation rapidly fixes the black solids to the page, which prevents bleeding of the black solids into the color regions of the printed image. Unfortunately, if the mutually precipitating color and black inks are mixed together in a conventional spittoon, they do not flow toward a drain or absorbent material. Instead, once mixed, the black and color inks rapidly coagulate into a gel with some residual liquid.

Thus, the mixed black and color inks not only may exhibit a rapid solid build-up, but the liquid fraction may also tend to run and wick (flowing through capillary action) into undesirable locations. To resolve the mixing problem, some printers used two conventional stationary spittoons, one for the black ink and one for the color inks. Unfortunately, each of these dual spittoons must be wide enough to avoid clogging from stalagmites growing inwardly from the side walls of the spittoon chimney. Such a dual-spittoon design, with the spittoons located between the printhead and other servicing components, further increased the overall width and footprint of the printer. Furthermore, besides growing from the sides of the spittoon, the ink stalagmites sometimes grew upwardly from the bottom of the spittoon. To prevent these stalagmites from interfering with the printhead over time, the use of very deep spittoons was typically required, which could also increase the overall printer size.

Simultaneously wiping two or more printheads, one containing a pigment based ink and the other containing dye based ink, has also been a challenge. Simultaneous wiping speeds the servicing routine, so the pens can quickly return to printing. New wiping strategies are needed to accommodate the pigment based inks. To maintain the desired ink drop size and trajectory, the area around the printhead nozzles must be kept reasonably clean. Dried ink and paper fibers often stick to the nozzle plate and the cheek areas adjacent the nozzle plate, particularly on a wide tri-color pen, causing print quality defects if not removed. Wiping the nozzle plate only removes excess ink and other residue accumulated near the nozzle orifices.

In the past, the printhead wipers have typically been a single or dual wiper blade made of an elastomeric material. Typically, the printhead is translated across the wiper in a direction parallel to the scan axis of the printhead, so for a pen having nozzles aligned in two linear arrays perpendicular to the scanning axis, first one row of nozzles was wiped and then the other row was wiped. A revolutionary orthogonal wiping scheme was used in the Hewlett-Packard Company's DeskJet® 850C color inkjet printer, where the wipers ran along the length of the linear arrays, wicking ink from one nozzle to the next. This wicked ink acted as a solvent to break down ink residue accumulated on the nozzle plate. This product also used a dual wiper blade system, with special contours on the wiper blade tip to facilitate the wicking action and subsequent cleaning.

Some of the earlier systems wiped laterally across the orifice plate and across areas adjacent the orifice plate, smearing ink along the entire under surface of the printhead. Other orthogonal wiping systems wiped only the printhead orifice plate and ignored the "cheek" regions to the sides of the orifice plate. If left unwiped, these cheek regions accumulated ink particles or residue, which unfortunately then collected bits of dust, paper fibers and other debris. If ink residue from the orifice plate was smeared over the cheeks during a lateral wipe, this residue accumulated even more debris. This cheek debris was then moved across a printed image by the printhead, smearing the printed ink and degrading print quality.

Challenges were also faced in finding suitable capping strategies for the new pigment based inks, while also adequately capping the multi-color dye based printhead. Capping hermetically seals the area around the printhead nozzles to prevent drying or decomposition of the ink during periods of printer inactivity. Once again, the Hewlett-Packard Company's DeskJet® 850C color inkjet printer employed a unique multi-ridged capping system that adequately sealed the pigment based black pen. A spring-biased sled supported both the black and color caps, and gently engaged the printheads to avoid depriming them. A unique vent system comprising a Santoprene® cap plug and a labyrinth vent path under the sled avoided inadvertent deprimes, while also accommodating barometric changes in the ambient pressure.

While the radically new service station employed in the DeskJet® 850C printer addressed a myriad of problems encountered with the new pigment based inks, it had a couple of drawbacks. First, the various servicing features were mounted on a rotary tumbler system, which had a drive mechanism that some customers perceived as being somewhat noisy, having almost a low growling sound. Second, the tumbler assembly had quite a few parts, including a sophisticated priming system, so the service station required a series of intricate manufacturing steps for assembly. When given the opportunity to design a new service station for a new product, designers of the DeskJet® 850C service station teamed with their colleagues to improve on the earlier design, and their new preferred embodiment is described in the Detailed Description below.

Earlier printers also had another problem involving the carriage device that moves the printhead back and forth across the page during printing. To prevent damage to the carriage and printheads during transport, it is desirable to hold the carriage in a fixed location, rather than letting it thrash back and forth inside the printer. In the past, different types of locking mechanisms have been used to secure the carriage, but they typically required a separate mechanical locking lever that the operator had to move to secure the carriage to the chassis. Other earlier printers needed special packing material inside the printer to secure the carriage for shipment from the factory. For instance, in several designs the carriage was held in place using cardboard or foam packing material, adhesive tape, and the like. All this packing material then had to be removed by the consumer before printing could begin, and if some was missed, the printer could fail to print causing unnecessary frustration to the consumer.

For later consumer transport after these printers had been used, the frictional forces of the caps against the printheads was the primary mechanism that secured the carriage in place. Unfortunately, without the pens installed, or if the consumer forgot to engage the locking lever, the sheer mass of these carriages could cause them to slam back and forth into the sides of the printer during transport, possibly damaging the carriage, its drive mechanism, or its positional feedback mechanism. Thus, it would be desirable to have an automatic carriage locking mechanism that is "transparent" to the consumer, needing no user intervention to remove packing material upon initial purchase or to secure the carriage in place when the printer is turned off.

SUMMARY OF THE INVENTION

According to one aspect of the present invention, a method of assembling a service station for servicing an inkjet printhead of an inkjet printing mechanism having a chassis, with the printhead defining a printhead plane. The method includes the step of mounting a pinion gear to a base of a service station frame supportable by the chassis, with the frame defining a guide track. The method also includes the steps of joining a sled carrying a cap for sealing the printhead to a pallet having a rack gear, and supporting a wiper for wiping the printhead on the pallet. In an installing step, the pallet is installed in the guide track for translational motion in a plane substantially parallel with the printhead plane. The method also includes the steps of coupling the pallet rack gear with the pinion gear, and securing the pallet in the guide track.

According to another aspect of the present invention, a service station is provided for servicing an inkjet printhead of an inkjet printing mechanism having a chassis, with the printhead supported by the chassis for motion along a scanning axis to a servicing position, and with the printhead defining a printhead plane. The service station has a frame supportable by the chassis, with the frame defining a guide track. A translationally moveable pallet is supported by the frame guide track for translational movement in a plane substantially parallel with the printhead plane and in a direction substantially perpendicular to the scanning axis. The service station also has a printhead servicing appliance supported by the pallet to service the printhead when in the servicing position.

In one illustrated embodiment, the service station frame has first and second opposing walls with the pallet located therebetween. The pallet has a biasing device that pushes against the second wall to bias the pallet toward the first wall, and the first wall of the frame has a pallet alignment datum located thereon. The pallet has a first alignment datum that engages the pallet alignment datum during a first portion of pallet movement as the biasing device pushes the pallet toward the first wall to align the pallet in a direction substantially parallel with the scanning axis.

In another illustrated embodiment, the service station frame has first and second opposing walls that define a pair of guide tracks opposing one another, with each of the pair of guide tracks having a load bearing surface. Here, the pallet has a pair of rail members that engage the pair of tracks, with each rail member having a lower surface with at least two contact members extending therefrom to ride on the load bearing surfaces of the tracks.

In a further illustrated embodiment, the printhead is transported by a carriage which is supported by the chassis for motion along the scanning axis. The pallet includes a carriage locking member that engages and secures the carriage with or without the inkjet printhead installed therein.

In yet another illustrated embodiment, the pallet has a rack gear, and the service station further includes a pinion gear supported by the frame to engage and drive the pallet rack gear to provide said translational movement to the pallet. The service station also has a motor mounted to the frame coupled to drive the pinion gear which moves the pallet via the rack gear. Preferably, the motor secures at least one transfer gear to the service station frame to couple the motor to the pinion gear.

In a further illustrated embodiment, the service station frame comprises a frame base and a bonnet cover attached to the frame base. The frame base defines a lower portion of the guide track, and the bonnet cover defines an upper portion of the guide track. The pallet has a rail member that is sandwiched between the lower and upper portions of the guide track.

According to a further aspect of the present invention, an inkjet printing mechanism is provided including a service station, which may be as described above.

An overall goal of the present invention is to provide a printhead service station for an inkjet printing mechanism that facilitates printing of sharp vivid images, particularly when using fast drying pigment based, co-precipitating, or dye based inks by providing fast and efficient printhead servicing.

Another goal of the present invention is to provide a printhead service station for an inkjet printing mechanism that operates faster and more quietly, has fewer parts, requires fewer assembly steps, and thus, is more economical than the earlier inkjet printing mechanisms.

A further goal of the present invention is to provide a method of servicing an inkjet printhead that is expediently accomplished in a quiet and efficient manner.

BRIEF DESCRIPTION OF THE DRAWINGS

FIG. 4 is a fragmented, perspective view of a slideable pallet portion of the service station of FIG. 3, shown carrying caps and wipers.

FIG. 5 is an enlarged perspective view of one form of an inkjet printhead wiper of the service station of FIG. 3.

DETAILED DESCRIPTION OF THE PREFERRED EMBODIMENTS

Figure 1:
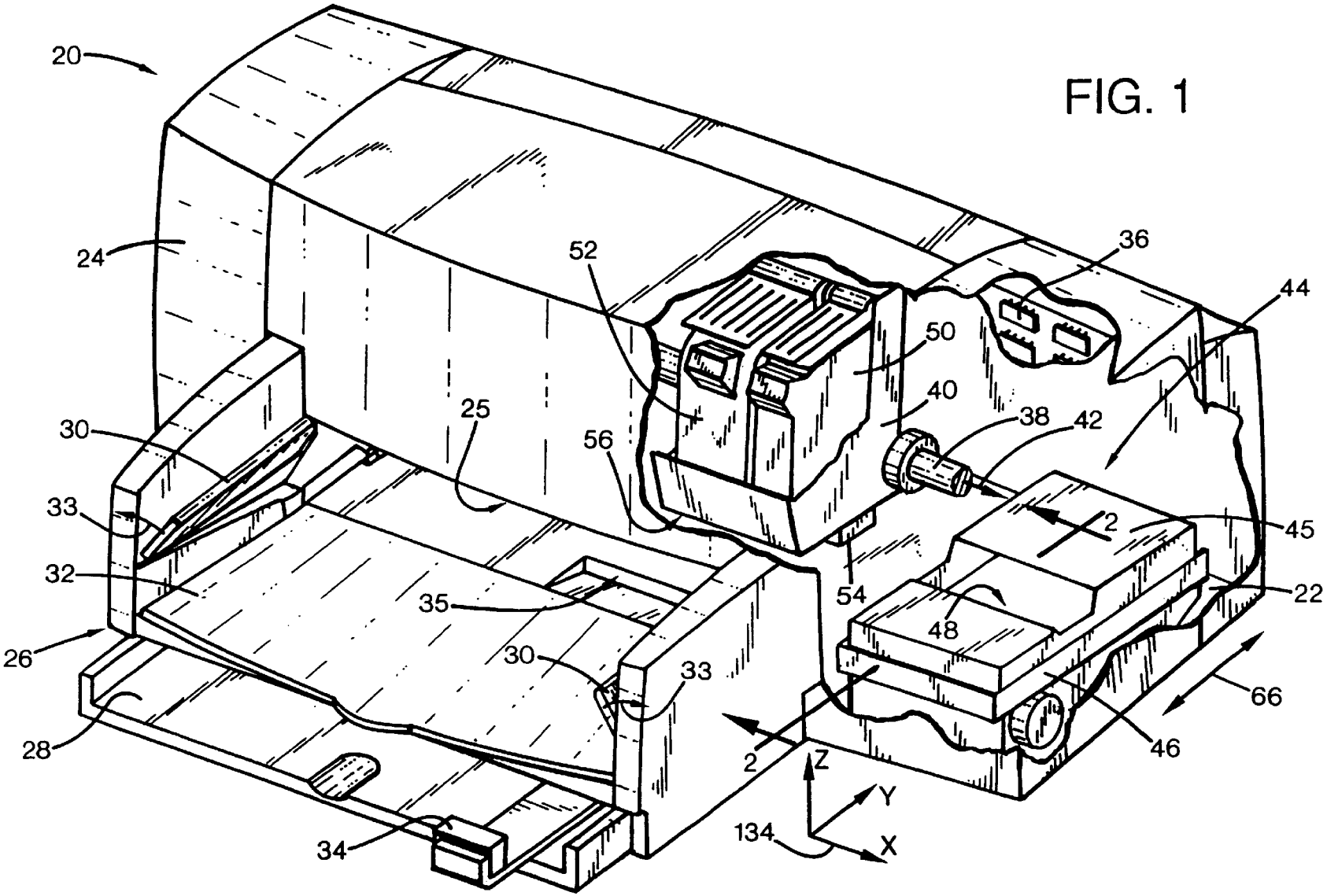
FIG. 1 is a fragmented, partially schematic, perspective view of one form of an inkjet printing mechanism including a translationally moveable servicing station of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a print zone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the print zone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the print zone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 holds a group of printhead servicing appliances, described in greater detail below. In FIG. 1, a spittoon portion 48 of the service station is shown as being defined, at least in part, by the service station frame 46.

In the print zone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the print zone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56.

Translational Service Station Basics—First Embodiment

Figure 2:
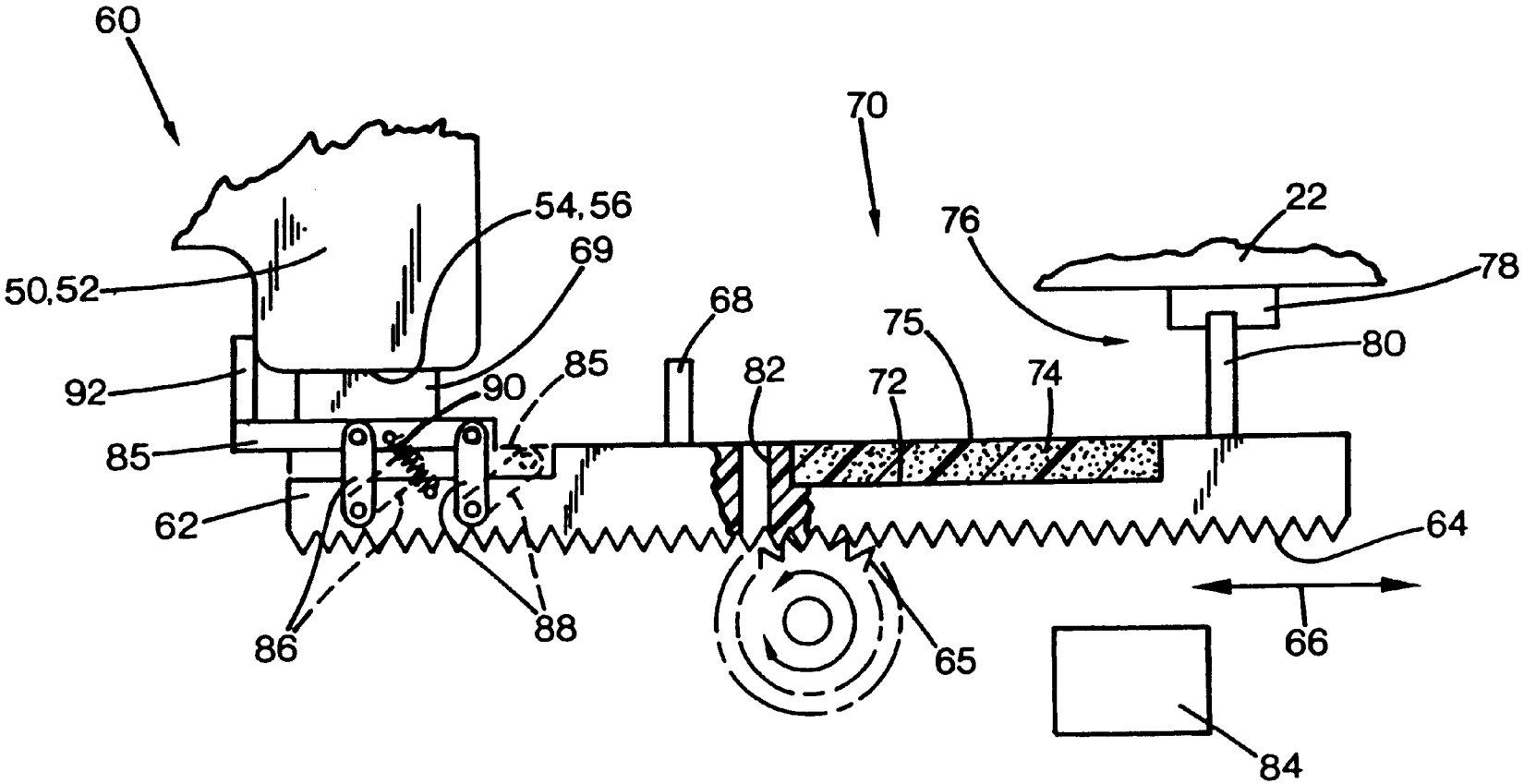
FIG. 2 is a schematic side elevational view of one form of a translationally moveable servicing station of the present invention shown in a capping position, and including a translational form of a moveable absorbent spitting station.

FIG. 2 schematically shows the operation of a basic translational service station 60 constructed in accordance with the present invention that may be located within the service station frame 46. The service station 60 has a translating platform or pallet 62, which may be driven linearly using a variety of different propulsion devices, such as a rack gear 64 formed along the underside of the pallet and driven by a pinion gear 65. The pinion gear 65 may be driven by a conventional motor and gear assembly (not shown) for translational motion as indicated by double headed arrow 66. The pallet 62 carries various servicing components, such as a pair of conventional wipers 68 and a pair of caps 69, each of which may be constructed from any conventional material known to those skilled in the art, but preferably, they are of a resilient, non-abrasive, elastomeric material, such as nitrile rubber, or more preferably, ethylene polypropylene diene monomer (EPDM). Remember, FIG. 2 simply illustrates some basic concepts of operation, which will aid the understanding of a more preferred embodiment shown in FIGS. 3–10.

The pallet 62 may also carry an absorbent or a non-absorbent purging or spitting station portion 70, which receives ink that is purged or "spit" from the inkjet printheads 54, 56. Located along a recessed spit platform portion 72 of the pallet 60, the preferred embodiment of spit station 70 includes an absorbent spit target, such as a spit pad 74, which is preferably made of a porous absorbent material. Preferably, the pad 74 is a wettable polyethylene compact material, particularly a porous compact material having surface and chemical treatments of the polymer so that it is wettable by the ink. One suitable pad material is commercially available under the tradename Poron, manufactured by the Porex company of Atlanta, Ga. Alternatively, the spit pad 74 may be of a polyolefin material, such as a polyurethane or polyethylene sintered plastic, which is a porous material, also manufactured by the Porex company. In a preferred embodiment, the absorption of the pad 74 is enhanced by prewetting the pad to better transport the ink vehicle or solvents through the pad pores. The pad 74 may be prewetted either before, during, or after assembly of pallet 62, using for example, a Polyethylene Glycol ("PEG") compound; however prewetting before assembly is preferred. Another suitable porous pad 74 may be of a sintered nylon material.

The spit pad 74 has an exterior surface serving as a target face 75. Preferably, the pad face 75 is located in close proximity to the printheads 54 and 56 during spitting, for instance on the order of (0.5 to 1.0 millimeters). This close proximity is particularly well-suited for reducing the amount of airborne ink aerosol. The spit platform 72 is substantially flat, although a contour for drainage or for air circulation to assist evaporation may be useful. The illustrated spit pad 74 is of a substantially uniform thickness, so the target face 75 is also substantially flat or planar in contour, although other surface contours may be useful, such as a series of grooves or other patterns to increase the target surface area for absorption.

To remove any surface accumulation of ink residue or other debris from the target face 75, the service station 60 may also include a spit pad scraper device 76. The illustrated scraper 76 has a support device 78 that mounts a blade member 80 to the printer chassis 22. To engage the target surface 75 with the scraper blade 80, the pallet 62 moves in the direction of arrow 66 so the scraper can clean target face 75. This spit debris is pushed by the scraper blade 80 into a drain or dump hole 82 formed through the pallet 62, which the debris falls through for collection in a bin 84 or other receptacle. So the target scraper 76 does not interfere with the printhead wipers 68, the wipers 68 have been positioned inboard from the spit pad 74.

A preferred material for the scraper blade 80, is a resilient, non-abrasive, elastomeric material, such as nitrile rubber, or more preferably, ethylene polypropylene diene monomer (EPDM), or other comparable materials known in the art. Another preferable elastomeric material for the scraper blade 80 is a polypropylene polyethylene blend (in a ratio of approximately 90:10), such as that sold under the tradename, "Ferro 4," by the Ferro Corporation, Filled and Reinforced Plastics Division, 5001 O'Hara Drive, Evansville, Ind. 47711. This Ferro 4 elastomer is a fairly hard material, that is not as elastic as typical EPDM wiper blades. The Ferro 4 elastomer has very good wear properties, and good chemical compatibility with a variety of different ink compositions. For example, suitable durometers (Shore scale A) for the scraper blade 80 may range from 35 to 100. In some implementations, hard scrapers, such as of a plastic like nylon, for example, may be suitable for cleaning the target pad 75. Indeed, a scraper formed of steel wire is not only inexpensive, but also allows encrusted ink to be easily broken away from the scraper.

To bring the wipers 68 and caps 69 into engagement with the printheads 54 and 56, the pallet 62 is moved in the direction of arrow 66, with the capped position being shown in FIG. 2. The pair of caps 69 are mounted to the pallet 62 using a printhead and/or carriage engaging cap elevation mechanism that includes a spring-biased sled 85. The sled 85 is coupled to pallet 62 by two pair of links 86 and 88, for a total of four links, each to the pallet 62 and the sled 85. Of the four links, only the two are visible in FIG. 2, with the remaining two links being obscured from view by the two links which are shown. The sled 85 may be biased into the lowered position, shown in dashed lines in FIG. 2, by a biasing member, such as a spring element 90.

Accordingly, sled 85 is subject to movement in direction 66, also referred to as plane 66 and path 66, and in a second direction defined by linkages 86 and 88. The second direction may also be referred to as a second plane and a second path of movement of the sled. These two directions of movement of sled 85 are both substantially perpendicular to scanning axis 42 and are non-parallel to each other.

When the carriage 40 has positioned the pens 50, 52 substantially above the service station 60, the pinion gear 65 drives the pallet 62 via the rack gear 64 until arms 92, extending upwardly from sled 85, engage either the body of pens 50, 52, or the carriage 40. The pinion gear 65 continues to drive the pallet 62 toward the right as shown in FIG. 2, which causes the sled 82 to rise upwardly from the pallet, extending the spring 90, until the caps 69 engage the respective printheads 54, 56. While the pairs of links 86, 88 are shown in an upright position to cap in FIG. 2, it is apparent that an angled orientation with respect to the pallet 62 may also be useful in some implementations, for example to accommodate slight elevational variations in the printheads 54, 56.

Thus, the pinion gear 65 may drive the pallet 62, via the rack gear 64, back and forth in the direction of arrow 66 to position the pallet 62 at various locations to service the printheads 54, 56. To wipe the printheads, preferably the platform is reciprocated back and forth (front to back of the printer 20). To spit through the nozzles to clear any blockages, or to monitor temperature rises and the like, the platform is moved into a nozzle clearing position where the spit target 75 is under the printheads. The capping motion of the platform is described above. To remove any ink residue from the surface of the spit target 75, the pallet 62 is moved until the target 75 is scraped by blade 80 and into bin 84. If necessary, the pallet 62 maybe reciprocated back and forth to scrape the target 75.

Translational Service Station—Second Embodiment

Figure 3:
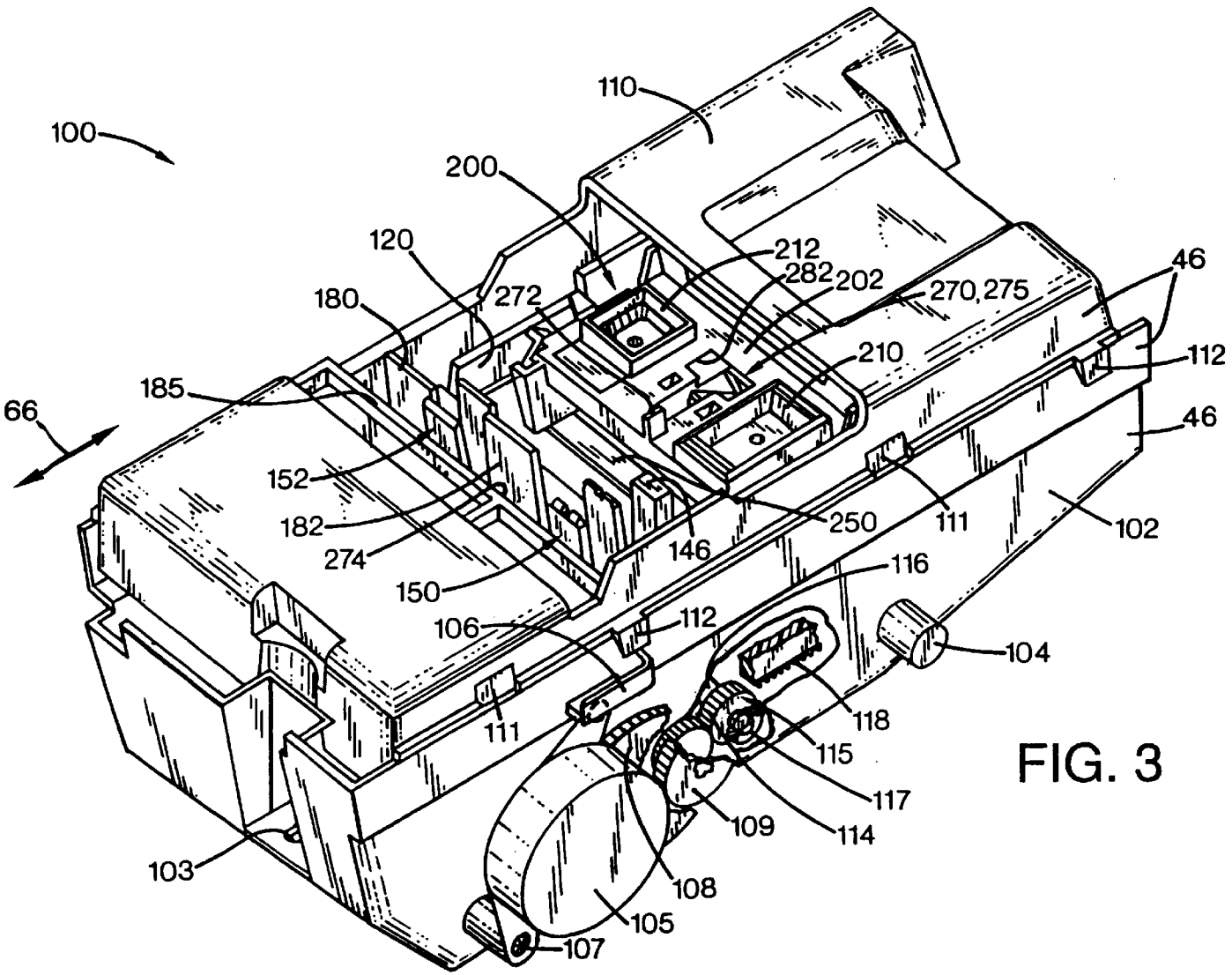
FIG. 3 is a fragmented, perspective view of one form of a service station of FIG. 1.

FIG. 3 illustrates a preferred embodiment of a transitional service station system 100 constructed in accordance with the present invention. Here, the service station frame 46 includes a base member 102 which may be attached to the printer chassis 22, for instance using a snap fastener, a rivet, a screw or other fastening device inserted through a slotted hole 103 defined by a front portion of the base 102. To adjust the elevation of the printhead servicing components, an adjustment mechanism (not shown) may be used to engage the frame, for instance using a pair of posts extending outwardly from each side of the frame base 102, such as post 104. As described further below, the frame base 102 also advantageously serves as the spittoon 48, as shown in FIG. 1.

The chassis 22, or more preferably the exterior of the base 102, may be used to support a conventional service station drive motor, such as a stepper motor 105. Preferably, the motor 105 has upper and lower mounting points, with the upper mount being secured to the frame base 102 using a clip member 106 that extends outwardly from the outboard side of the base 102. The base 102 may also have a boss, or other fastener receiving structure, here extending outwardly from the outboard side to receive a fastener, such as screw 107, that secures the lower motor mount to the base 102. The stepper motor 105 is operatively engaged to drive a first transfer gear 108, using one or more reduction gears, belts, or other drive means known to those skilled in the art, here shown driving a second transfer gear 109. Both the first and second transfer gears 108, 109 are preferably mounted to posts extending from the outboard side of the base 102. In the preferred embodiment, gear 109 is first assembled to the base 102, followed by gear 108, which has a portion that overlaps an axle extension of gear 109. The motor 105 then overlaps an axle extension of gear 108. When the motor 105 is attached by clip 106 and fastener 107 to the base 102, this overlapping scheme uses the motor 105 to secure the gears 108 and 109 to the base 102, without requiring separate pins, snap rings, or other retainers to hold gears 108, 109 in place.

Finally, to complete the service station frame 46, an upper portion or bonnet 110 of the frame 46 is secured to the frame base 102, preferably using snap hooks 111 and tapered guides 112.

The transfer gear 109 engages one of a pair of drive gears 114 of a spindle pinion drive gear assembly 115. The pair of pinion gears 114 reside along opposite sides of the service station frame 102, and are coupled together by an axle portion 116. The axle 116 of the spindle pinion gear 115 is supported by a pair of bearing mounts, such as bearing mount 117 in FIG. 3, shown extending from the interior of the frame base 102. The pair of gears 114 each engage respective pairs of rack gears 118 (FIGS. 4 and 8–9) formed along a lower surface of a translationally movable pallet 120 to move the pallet in the directions indicated by the double-headed arrow 66.

FIG. 4 illustrates the manner of supporting and aligning the pallet 120 with the base 102 and bonnet 110 of the service station frame 46. The pallet 120 has an inboard side 122 facing toward the print zone, and an outboard side 124 facing toward the right side of printer 20 as shown in FIG. 1. The inboard side 122 has a divided guide rail comprising a pair of rail segments 126, and the outboard 124 has a continuous guide rail 128. The guide rails 126, 128 ride within a pair of tracks 130, defined by the intersection of the frame base 102 and bonnet 110, with the outboard track 130 shown being engaged by guide rail 128 in FIG. 4 (see FIG. 10 for the inboard track 130 being engaged by rail 126). In a preferred embodiment, to quiet the sliding action of pallet 120 rather than the entire rails 126, 128 traversing the tracks 130, the rails are supported at two (or more) contact points. Here, the lower surfaces of each segment of the guide rail 126 have a small support rib 132 formed thereon, and the lower surface of the long outboard guide rail 128 has a similar pair of support ribs formed thereon, preferably at each end of the guide rail 128. Thus, when sliding in track 130, the pallet 120 is supported by these four points 132, rather than by the entire length of the guide rails 126, 128, which advantageously prevents binding and minimizes frictionally induced noise.

To align the service station components in the X direction, as shown by the XYZ coordinate axis 134 in FIGS. 1 and 4, the pallet inboard side 122 is equipped with a pair of biasing members, such as spring arms 135, which each have a contact surface 136 that extends outwardly beyond the guide rails 126 when disassembled. When the pallet guide rails 126, 128 are inserted in the tracks 130, the spring arm contacts 136 push against the inboard guide track 130 to force the outboard side of pallet 120 toward the outboard track 130, that is, toward the positive X direction and advantageously, into engagement with X axis alignment features.

For X axis alignment, the outboard side of pallet 120 has two X alignment datums extending therefrom, specifically, a cap X datum rib 138 and a wiper X datum rib 140. In FIG. 4, the wiper X datum rib 140 is shown engaging a pallet X alignment datum plate 142 formed along an interior wall of the frame bonnet 110. As the pallet moves forward (negative Y direction) for capping, as described further below, the cap X datum rib 138 comes into engagement with the datum plate 142. One may ask how a single pallet contact point 138 or 140 with the bonnet datum 142 could provide proper alignment without producing torque in pallet 120 around the Z axis. Advantageously, an anti-torque feature is provided by the engagement of the dual gears 114 of the spindle pinion 115 with the pair of rack gears 118 located along both the inboard and outboard undersides of the pallet. The meshing of the dual rack and spindle pinion gears 118, 114 prevents any rotation the pallet 120 around the Z axis.

Preferably, the pallet alignment datum plate 142 is located approximately in line with the printheads 54, 56. To align the printheads 54, 56 with the servicing components, the frame bonnet 110 also has a carriage X datum alignment land 144, which preferably is adjacent the pallet datum plate 142. Preferably the pallet and carriage alignment datums 142, 144 are formed integrally with the bonnet 110. By placing the pallet and carriage datums 142, 144 in the same general location, the accuracy of the X axis alignment of the printheads 54, 56 with the components of service station 45 is significantly enhanced over earlier designs, which placed alignment features external to the service station.

Another unique carriage alignment feature is provided by a carriage lock arm 145 that extends upwardly from the inboard rear side of pallet 120. When the printhead carriage 40 is in the servicing region 44, the pallet 120 is moved forward until the carriage lock arm 145 engages and secures a portion of the carriage. Advantageously, the carriage lock arm 145 securely captures the carriage 40 in the servicing region, whether the pens 50, 52 are installed or not. For consumer transport, there is no need for separate user intervention to move any locking lever, as in the earlier printers. Furthermore, additional material cost and manufacturing steps associated with using packing or restraining material and tape to secure the carriage in place are no longer required. This also provides a customer advantage because this packing material, blocking and tape no longer needs to be removed before the customer can begin printing. Thus, the printer 20 approaches a desired goal of a "plug and play" design, requiring little or no consumer attention between purchase and use (other than removing the printer from the box).

The service station pallet 120 also includes a Z axis alignment datum 146, such as the upwardly extending Z axis datum post 146. During initial assembly, a probe can be located on the upper surface of the datum 146, and the rear end of the service station base 102 may be raised or lowered as desired by engaging the Z axis alignment posts 104. Advantageously, this adjustment may be made at the same time that the printhead to media spacing is measured and adjusted, and in some implementations these measurements may be made using the same tool. It is apparent that a variety of different mechanisms known to those skilled in the art may be used to raise and lower the rear end of the service station base 102 after it has been secured to the chassis 22 at slot 103. It is also apparent that other means may be used to provide the proper spacing between the service station appliances and the printheads, such as by the printhead adjusting the printhead carriage 40 and/or the carriage guide rod 38.

The pallet 120 includes a wiper support 148, preferably located toward the front end of the pallet. Mounted along the upper surface of the wiper support 148 are black and color printhead wiper assemblies 150, 152 for orthogonally wiping the orifice plates of the respective black and color printheads 54, 56. FIG. 5 shows the details of the black printhead wiper assembly 150, supported by platform 148. The illustrated black ink wiper 150 is designed to efficiently clean the black printhead 54 by using two upright spaced-apart, mutually parallel blade portions 154 and 156, each having special tip contours. The color ink wiper assembly 152 shown in FIGS. 3 and 4, may also have two spaced-apart, mutually parallel upright blade portions 158 and 160 for wiping the color pen 52, here, containing three dye based inks of cyan, magenta, and yellow, for instance. The wiper blades 154–160 may be joined to the platform 148 in any conventional manner, such as by bonding with adhesives, sonic welding, or more preferably by onsert molding techniques, where the base of the wiper blade extends through holes formed within platform 148. In the illustrated embodiment, the wiper blades 154–160 are each of a non-abrasive resilient material, such as an elastomer or plastic, a nitrile rubber or other rubber-like material, but preferably of an ethylene polypropylene diene monomer (EPDM), or other comparable material known to those skilled in the art.

In the illustrated embodiment, the black pen 50 contains a pigment based ink which generates a gummy residue wiper that resists wiping using a conventional wiper, as described in the Background portion above. Each of the black wiper blades 154 and 156 terminate in a wiping tip at their distal end. Preferably the wiping tips have a forked geometry, with the number of fork tongs equal to the number of linear nozzle arrays on the corresponding printhead, here two fork tongs for the two linear nozzle arrays of printhead 54. Thus, the wiper blades 154, 156 each have a pair of wiping surfaces 162, 164 which are separated by a recessed flat land portion 166. In the illustrated embodiment, each of the wiper tips 162, 164 are also flanked on their outboard sides by recessed flat land portions 168, 170.

In the illustrated embodiment, both the color wiper blades 158, 160 and the wiper tips 162, 164 of the black blades 154, 156 each have an outboard rounded edge 172 adjacent the outboard surfaces of the blades. Opposite each rounded wiping edge 172, the wiping tips of blades 154–160 may terminate angularly, or more preferably, in a square edge 174 adjacent the inboard surfaces of the blades. The rounded tips 172 assist in forming a capillary channel between the blade and the nozzle orifice plate to wick ink from the nozzles as the wipers move orthogonally along the length of the nozzle arrays. This wicked ink is pulled by the rounded edge 172 of the leading wiper blade to the next nozzle in the array, where it acts as a solvent to dissolve dried ink residue accumulated on the printhead face plate. The angular edge 174 of the trailing wiper blade then scrapes the dissolved residue from the printhead face plate. That is, when the platform is retreating toward the rear of the printer (to the left in the views of FIGS. 4 and 5), the black blade 154 and the color blade 158 are the leading blades wicking ink with their rounded edges 172, while blades 156 and 160 are the trailing blades, scraping away residue with their angular edges 174. The recesses 166, 168 and 170 serve as escape passageways for balled-up ink residue to be moved away from the nozzle arrays during the wiping stroke.

The color wiper 152 may be constructed as described above for the black wiper 150, but preferably without the escape recesses 166, 168, 170. Instead, the color wiper blades 158, 160 each have arced surfaces along their entire outboard width, as shown for edge 172 on the black wiper blades 154, 156. The color wiper blades 158, 160 each have a singular angular wiping edge along their inboard surfaces, as illustrated for the angular cleaning edge 174 of the black wiper blades.

For convenience, all of the wiper black wiper blades 154, 156 and color wiper blades 158, 160 will be referred to herein collectively as wipers 150, 152, unless otherwise noted.

Figure 6:
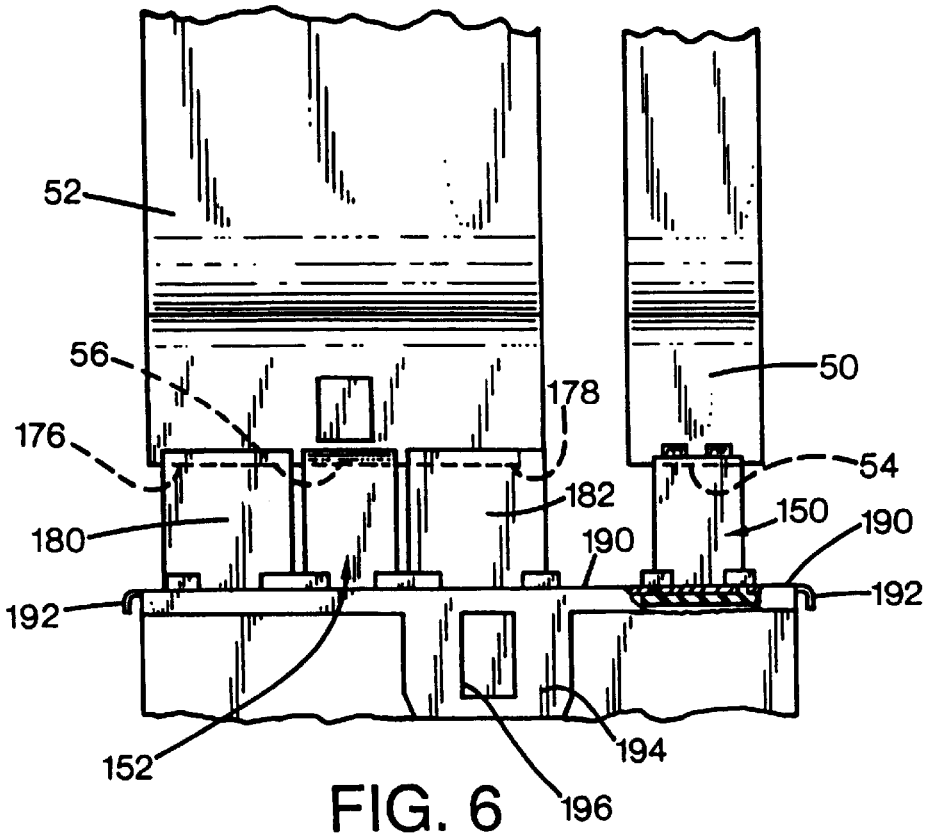
FIG. 6 is an enlarged front elevational view of the inkjet printhead wipers of the service station of FIG. 3, shown wiping black and color inkjet printheads, with the balance of the service station omitted for clarity.

Some of the earlier wiping systems, described in the Background portion above, wiped across the orifice plate and across areas adjacent the orifice plate, smearing ink along the entire under surface of the printhead. Others wiped only the printhead orifice plate and ignored regions to the sides of the orifice plate. As shown in FIG. 6, the color cartridge 52 has a wider body than the black cartridge 50. The sides of the color cartridge 52 extend straight down to the printhead area, so two wide, flat lands or cheeks 176 and 178 are created to each side of the printhead orifice plate 56. In the earlier printers using this style of cartridge, these cheeks 176, 178 were left unwiped. Unfortunately, the cheeks 176, 178 occasionally accumulated ink particles or residue, then bits of dusts, paper fibers and other debris stuck to this residue. Left unwiped, this cheek debris could then be pulled across the page during printing. If enough debris had accumulated, it could actually smear the printed ink, degrading print quality.

To address the cheek debris issue, the translating service station 100 includes outboard and inboard cheek wiping members, affectionately referred to by their designers as "mud flaps" 180, 182, shown in FIG. 6. The mud flaps 180, 182 may be constructed of the same elastomeric material as the wipers 150, 152. Indeed, use of a single type of elastomer for both the wipers 150, 152 and the mud flaps 180, 182 speeds the manufacturing process because the wipers and mud flaps may then be formed in a single molding step. While the wiper blades have a curved outboard surface 172, the preferred tip for the mud flaps 180, 182 is rectangular in cross section, having forward and rearward angular wiping edges, similar to edge 174 shown in FIG. 5.

To remove ink residue from the tips of the wipers 150, 152 and the mud flaps 180, 182, the service station bonnet 110 advantageously includes a wiper scraper bar 185, as shown in FIG. 3. The scraper bar 185 has a lower edge which is lower than the tips of wipers 150, 152 and flaps 180, 182. Thus, when the pallet 120 is moved in a forward direction, the wipers 150, 152 and flaps 180, 182 hit the scraper bar 185, and advantageously flick any excess ink at the interior surfaces of the front portions of the bonnet 110 and base 102. This built-in wiper scraper 185 is much more economical that the earlier mechanisms that required elaborate camming mechanisms, intricate scraper arms, and blotter pads to absorb excess liquids from the inks. During capping (FIG. 9), the wipers and mud flaps are hidden under the front shroud of bonnet 110, making them inaccessible to an operator. So when the printer is turned off, an operator cannot become soiled from inadvertently touching the wipers and mud flaps because they are hidden from reach, as well as being protected from damage.

It is apparent that the wipers 150, 152 and mud flaps 180, 182 may be onsert molded directly onto the pallet wiper support 148, or otherwise attached using a variety of methods known to those skilled in the art. In a preferred embodiment, the wipers and mud flaps are onsert molded onto a sheet of metal, such as a spring steel, which may be bent and formed to provide a removable wiper mount 190, shown in FIG. 6. The wiper mount 190 may start as a long strip of stainless spring steel which is first punched in a flat state to define several of the features of its final construction, including a series of holes extending through the strip in the region under the wipers and mud flaps. These holes are used to onsert mold the wipers 150, 152 and the mud flaps 180, 182 to the upper surface of the mount 190.

Indeed, a series of wiper mounts 190 may be formed along a single strip of steel, so that several sets of wipers and flaps may be onsert molded in a single step. In one or more finishing operations, each of these individual mounts are severed from one another, their sides are turned down to form ears 192 at each end and engagement tabs 194 with slots 196 therethrough. The use of spring steel allows the tabs 194 to expand outwardly over a pair of pallet mounting ears 198 extending forward and aft of the wiper support 148.

The hooks 198 are then received within slots 196 to secure the wiper mount 190 to the pallet wiper support 148, as shown in FIG. 4.

The other major component supported by the pallet 120, is the capping assembly 200, which includes a raiseable cap support platform or sled 202. As shown in FIG. 4, the cap sled 202 has two upwardly extending alignment or contact arms 204 and 206 configured to engage the printhead carriage 40 to facilitate capping, as described further below. The capping assembly 200 has black and color caps 210, 212 for sealing the respective black and color printheads 54, 56. The caps 210, 212 may be joined to the sled 202 by any conventional manner, such as by bonding with adhesives, sonic welding, or more preferably by onsert molding techniques. In the illustrated embodiment, the caps 210, 212 may be of a non-abrasive resilient material, such as an elastomer or plastic, a nitrile rubber or other rubber-like material, but more preferably, caps 210, 212 are of an ethylene polypropylene diene monomer (EPDM), or other comparable material known to those skilled in the art.

Figure 7:
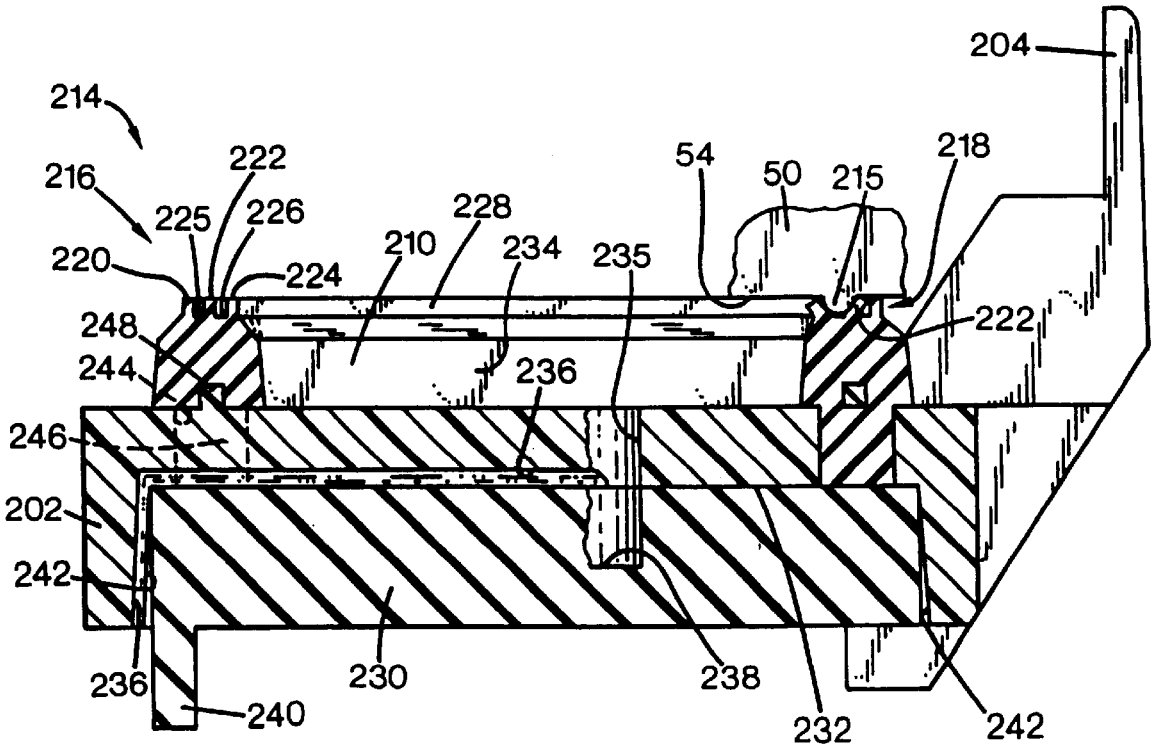
FIG. 7 is an enlarged sectional view taken along lines 7—7 of FIG. 4.

FIG. 7 illustrates a preferred embodiment of a capping assembly 214 constructed in accordance with the present invention, here shown as including a multi-ridge black printhead cap 210. To provide higher resolution hardcopy printed images, recent advances in printhead technology have focused on increasing the nozzle density, with levels now being on the order of 300 nozzles per printhead, aligned in two 150-nozzle linear arrays for the black pen 50. These increases in nozzle density, present limitations in printhead silicon size, pen-to-paper spacing considerations, and media handling constraints have all limited the amount of room remaining on the pen face for capping. While the printhead and flex circuit may be conventional in nature, the increased nozzle density requires optimization of cap performance, including sealing in often uneven sealing areas. For example, the printhead nozzle surface 54 is bounded on each end by two end beads 215 of an encapsulant material, such as an epoxy or plastic material, which covers the connection between a conventional flex circuit and the printhead housing the ink firing chambers and nozzles. The protective end beads 215 occupy such a large portion of the overall printhead area, that providing a positive, substantially moisture impervious seal around the printhead nozzles is difficult using a conventional single sealing ridge or lip, such as the single lip of the color cap 212 (FIGS. 3 and 4). Indeed, other than the multi-ridge feature, the following description of the black cap assembly, including the sled attachment and venting features, apply equally to the color cap 212.

To seal across the uneven end beads 215, the black cap 210 preferably has a lip comprising adjacent plural or redundant contact regions, such as multi-ridged capping zones 216 and 218. The illustrated multi-ridge cap areas 216,218 have a two or more substantially parallel ridges or crests, here shown as having three ridges 220, 222 and 224 separated by two troughs or valley portions 225, 226. Along the longitudinal lip region parallel to the linear nozzle arrays, the black cap 230 has two single-ridged sealing surfaces 228. The multi-ridge cap area 218 is shown in FIG. 7 sealing the pen face 54 over the end bead 215 by compressing the intermediate ridge 222 more than other two crests. These wide sealing regions 216, 218 also seal over ink residue or other debris accumulated on the pen face 54.

The capping assembly 214 also includes a chamber vent cap or stopper 230, which sits within a recess 232 formed along the underside of the capping sled 202. Preferably, the vent cap 230 is of a Santoprene® rubber sold by Monsanto Company, Inc., or other ink-phyllic resilient compound structurally equivalent thereto, as known to those skilled in the art. Preferably, the cap sled 202 is of a polysulfone plastic or other structurally equivalent plastic known to those skilled in the art. When sealed against the printhead surface, the ridges 220, 222, 224 and 228 define a main sealing cap chamber or cavity 234, which is in fluid communication with a vent hole 235 defined by the sled 202.

The vent cap recess 232 includes a pressure equalization groove or venting channel 236 formed along the underside of the capping sled 202. The channel 236 provides a pressure equalizing vent passageway from the main sealing chamber 234 to atmosphere when the vent stopper 230 is installed. To aid in pressure damping during capping, the stopper 230 also defines a damping chamber 238 therein. The damping chamber 238 is in communication with the cap chamber 234, via the vent hole 235, and channel 236, which provides an escape passage way for air trapped between the printhead 54 and the cap 210 during capping. When capped during extended periods of printer inactivity, the vent channel 236 prevents printhead depriming by allowing an equal pressure to be maintained between the cap chamber 234 and the ambient environment, even during changes in barometric pressure, temperature, and the like.

To assist in drawing ink through channel 236, the vent stopper 230 has a drain stick 240 formed of the same materials as the main body of stopper 230. Clogging of the vent channel 236 by ink accumulation is avoided by using a Santoprene® or other ink-phyllic compound for the vent stopper 230. In the areas where the stopper 230 meets the sled 202, small passageways are formed, which through capillary action pull any accumulated ink out of the channel 236. Through capillary draw, the wicked ink fills the sharp comers and small spaces where stopper 230 meets sled 202, such as at gap 242.

Preferably, the caps 210 and 212 are onsert molded to the sled 202 using a plurality of onsert molding holes, such as hole 244, formed through the sled 202 and filled with a portion of the cap material in a plug form 246. Preferably, a molding race 248 projects upwardly from the upper surface of the sled 202 and runs between the molding holes 244 under the cap lips to aids in adhering the caps 210, 212 to the sled 202. Other than the multi-ridge lip feature, the above description of the black cap assembly 214, including the sled attachment and venting construction, applies equally to color cap 212.

Figure 8:
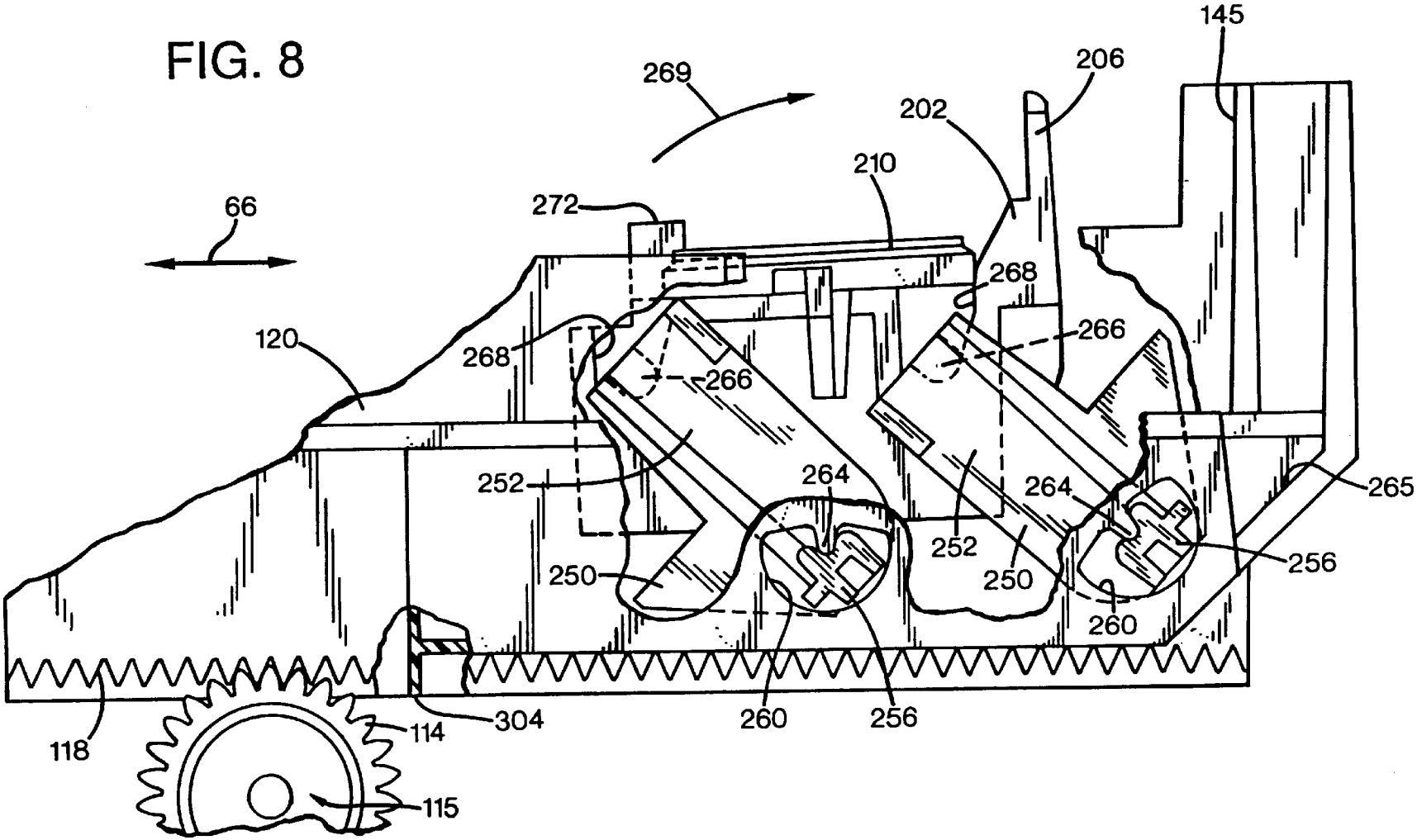
FIGS. 8 and 9 are enlarged and fragmented, side elevational views taken along lines 8—8 of FIG. 4, with FIG. 8 showing the caps lowered in a rest state, and FIG. 9 showing the caps raised in a capping state.
Figure 9:
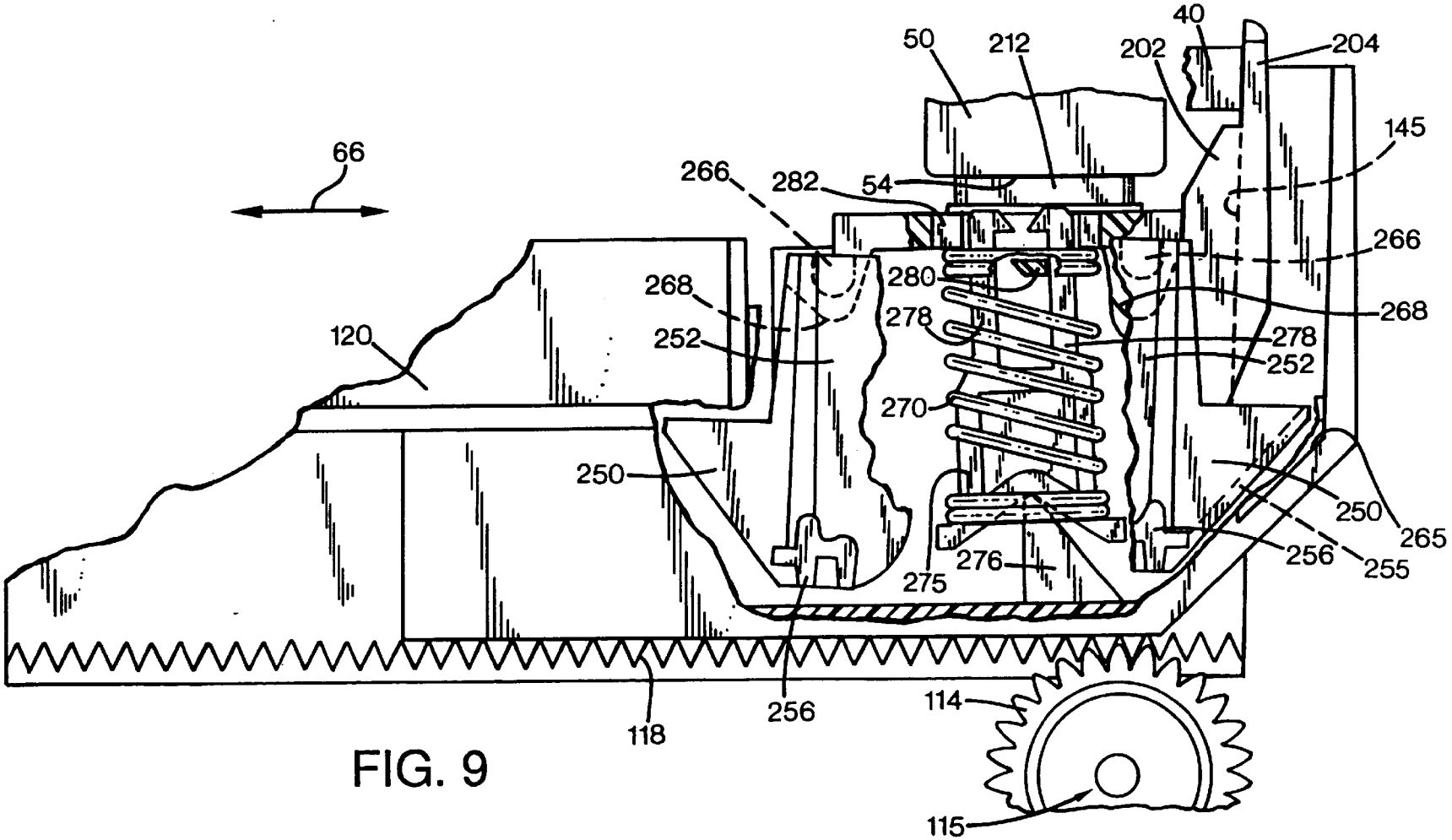

In FIGS. 4 and 8–9, one method of coupling the sled 202 to the pallet 120 is illustrated as using two link or yoke members 250. The yokes 250 are dual pivot structures, having two upright ear members 252 and 254 joined together by a bridge member 255 (FIG. 4). The ears 252, 254 each have lower pivot members 256, 258 which extend through the respective half-moon shaped slots 260, 262 defined by the opposing sidewalls of the pallet 120. The half-moon shaped slots 260, 262, each define pivot shoulders, such as shoulders 264 shown in FIGS. 8 and 9. The yoke lower pivots 256, 258 engage and toggle around the pivot shoulders 264 during capping and uncapping, as seen by comparing the uncapped position of FIG. 8 with the capped position of FIG. 9. Raising of the sled 202 is limited when forward motion of the pallet 120 is stopped by contact of the carriage lock arm 145 on the pallet 120 with the carriage 40, as shown in FIG. 4. Advantageously, the Θ-X positioning accuracy (that is, rotation around the X axis) of the caps 210, 212, the spring 270, and link 275 is enhanced by this design, because both the pallet 120 and the sled 202 rest against the same portion of the printhead carriage 40. Thus, travel variation of the sled 202 is virtually eliminated.

The second portion of the dual pivot structure of yokes 250 is provided by wedge-shaped pivot hooks 266 along the upper inner surface of each of the ears 252 and 254, as shown for hooks 266 on ears 252 in FIGS. 8 and 9. Each pivot hook 266 is captured by and received within a pocket 268 of sled 202, shown at rest in FIG. 8. As the pallet 120 moves forward (to the left in FIGS. 8 and 9) when the pens 50, 52 are in the servicing region 44, the sled arms 204, 206 engage the carriage 40 (FIG. 4). The yoke arms 252, 254 are all of equal length and angular orientation with respect to the pallet 120 and sled 202 to form a shifting parallelogram structure, as seen by comparing FIGS. 8 and 9. Thus, when actuated, the sled 202 maintains an orientation parallel to its rest position (FIG. 8) while the yokes 250 sweep the sled 202 through an arcuate path, as indicated by curved arrow 269 (FIG. 8). Upward motion of the sled 202 continues until the caps 210, 212 engage printheads 54, 56 and the lock arm 145 on the pallet 120 captures the carriage 40, stalling the motor 105. When in the capping position of FIG. 9, the hooks 266 preferably float within pockets 268 so the caps maintain a maximum seal against the printheads due to a capping force provided by a third sled support comprising a biasing member, such as a coil spring 270 which is compressed during capping.

Before describing the operation of spring 270, it is noted that the cap sled 202 is prevented from traveling under the wiper scraper bar 185 when the carriage 40 is not in the servicing region to avoid unnecessary soiling of the caps 210, 210 by ink residue accumulated along the bar 185. This operation is accomplished by an upright post 272 located along the front edge of the sled 202 which engages a preferably reinforced stop portion 274 of bar 185 (see FIG. 3). After contact of the sled post 272 with stop 274, further forward motion (to the left in FIG. 3) forces the links 250 to pivot and lift the cap sled 202 upward into an elevated position. This position is referred to as "elevated," not "capping," because without contacting the printheads 54, 56, there is no compression of spring 270, and the yoke hooks 266 rest at the bottom of pockets 268. Thus, the caps 210, 212 are prevented from being fouled and dirtied by ink residue on the wiper scraper bar 185. Another significant advantage is provided by the sled post 272 and the sled arms 204, 206. During shipping from the factory, typically the pens 50, 52 are not installed in printer 20, which preserves pen life during shipment and while awaiting sale of the printer 20. When the carriage lock 145 secures the carriage 40 in place without the pens 50, 52 being installed, the sled arms 204, 206 and the upper surface of the sled post 272 contact the carriage 40 to hold the sled 202 firmly in a pseudo-capped position during transport.

The spring 270 biases the sled 202 in a lowered rest position, as shown in FIG. 8, using a rocking spring retainer or rocker member 275 that rests upon the rocker pivot post 276, which projects from the pallet 120. This biasing action of spring 270 also serves to retract the capping assembly 200 from the capped position and to transition the sled 202 to the rest position after uncapping. The rocker 275 has a pair of projecting finger members 278, which both terminate in latches that grasp a pivot pin or post member 280 of the sled 202. As shown in FIGS. 3 and 4, the sled pivot post 280 is recessed within a roughly T-shaped slot 282 defined by sled 220, with the slot 282 being wide enough to slidably receive therethrough the tips of the retainer fingers 278. Preferably, the spring 270 is under a slight compression when assembled to bias sled 202 into the lowered rest position. The sled post 280 travels downwardly through the slot formed between the pair of rocker fingers 278 under the downward force produced by capping the printheads 50, 52, which compresses the spring 270 further. This stressing of spring 270 during capping securely seals and maintains a controlled pressure against the printhead nozzle plates 54, 56, even when the printer unit 20 has been turned off. Indeed, the capping force applied to the printheads 54, 56 may be adjusted by selecting a spring with a desired spring force characteristics.

Finally, the undersizing of the yoke hooks 266 with respect to the width of the sled pockets 268 as shown in FIG. 9, allows the sled 202 to twist or skew respect to the pallet 120 as the sled arms 204, 206 contact the carriage 40 to move to the capping position. This floating nature of the sled 202 when capping also allows the capping assembly 200 to have a gimbaling or tilting action so the sled 202 can tilt to compensate for irregularities on the printhead face, such as ink build up or the black pen encapsulant beads 215, while still maintaining a pressure tight seal adjacent the pen nozzles. The two yokes 250 operate in part like a four-bar linkage mechanism, used in the past to elevate servicing components in response to carriage motion. However, the earlier four-bar linkage mechanism lacked the bridges 255 which add stability and ease of assembly to the illustrated design. Moreover, the earlier design was incapable of achieving this floating action for the capping sled, where the coil spring 270 biases the caps 210, 212 upwardly into engagement with the printheads 54, 56.

Figure 10:
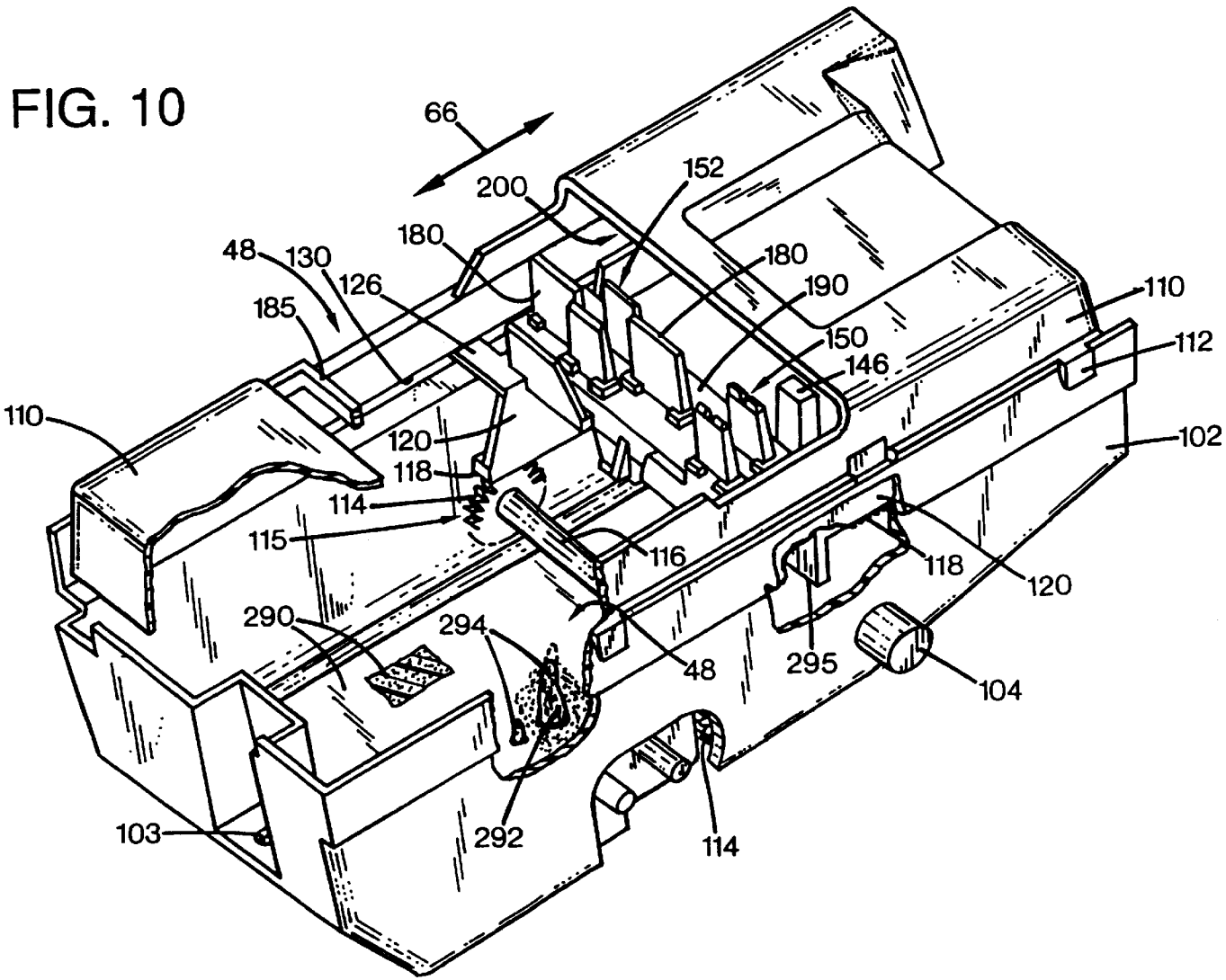
FIG. 10 is a fragmented, perspective view of the service station of FIG. 3, shown with the pallet portion retracted to a home position to expose a spittoon portion of the service station.

FIG. 10 illustrates the position of pallet 120 for the second embodiment of the spitting routine. Here, the pallet 120 is retracted toward the rear of the service station frame 46, in what is advantageously used during the servicing routine as a home or rest position. The service station drive motor 105 moves the pallet 120 all the way toward the rear until the rear of the pallet 102 contacts the rear portion of the frame base 102. Once no further rearward motion is accomplished, the logic within the printer controller 36 is reestablished at a zero position. From this zero position, subsequent motor steps are then referenced to locate the pallet 120 at the proper capping, wiping, locking and spitting positions.

In the illustrated embodiment, the interior of the frame base 102 is substantially enclosed to prevent the escape of ink while serving another role, specifically that of the spittoon 48 to capture ink spit from pens 50, 52. The spittoon 48 has a lower surface defined by the interior surface of the frame base 102 that may be lined with an absorbent spit pad 290, preferably located beneath the entrance to spittoon 48. The spit pad 290 may be of any type of liquid absorbent material, such as of a felt, pressboard, sponge or other material. One preferred material is an open cell foam sponge material, sold by Time Release Sciences, Inc., 1889 Maryland Ave., Niagara Falls, N.Y. 14305, as type SPR100 material.

As mentioned in the Background portion above, accumulated spitting of ink, particularly of the pigment based black ink from pen 50, often results in the formation of ink towers or stalagmites, such as stalagmite 292 having a top portion 294, as shown in FIG. 10. One particular advantage of the transitional motion of pallet 120 back and forth over the spittoon region 48, is the inclusion of the stalagmite decapitating ridge 295 located along the underside of pallet 120 to bull-doze over the growing stalagmites. Preferably, the stalagmite decapitator 295 extends between the pair of rack gears 118. Forward motion of the stalagmite decapitator 295 mows over and breaks off the top 294 (shown in dashed lines) of the stalagmite 292. The stalagmite decapitator 295 then knocks these top solids 294 (shown in solid lines) forward and onto the spit pad 300, so that they do not grow to contact the pen faces or interfere with operation of the rack and pinion gears 114, 118.

In operation, one preferred method of servicing the printheads 54, 56 may occur upon initial start-up of the printer 20 after a period of printer inactivity. When stored, the pens 50, 52 are capped by the cap assembly 200, as shown in FIG. 9. Upon start-up the pallet 120 first moves rearwardly to uncap the pens. Rearward motion is continued, which causes the wipers 150, 152 and flaps 180, 182 to wipe the respective printheads 54, 56 and the color pen cheeks 176, 178. Continued rearward motion of the pallet 120 to the home position then hides the cap assembly 200 under the rear shroud portion of bonnet 110, leaving the spittoon 48 accessible as shown in FIG. 10 for spitting. With the cap assembly 200 hidden under the rear portion of bonnet 110, it is advantageously protected from soiling by any airborne ink aerosol particles generated during the spitting routine.

Following uncapping, wiping and spitting, the pens 50, 52 are then free to be transported by carriage 40 to the printzone 25 for printing. Periodically during printing, it may be desirable to return the pens 50, 52 to the service station 45 for spitting followed by a quick wiping routine, accomplished by moving the pallet 120 forward from the rest position. It is apparent that scrubbing or multiple wiping strokes may be easily accomplished by reciprocating the pallet 120 forward and aft while allowing the wipers 150, 152 to stroke and clean the printheads 54, 56. For a return to the inactive state, the pens 50, 52 may be brought back into the servicing region 44, and spit, then wiped clean and capped through a single stroke of forward pallet motion.

Advantages

Advantageously, both printheads 54, 56 may be spit simultaneously into spittoon 48 without moving the carriage 40. Earlier printers had to position first one printhead over the spittoon, then the carriage has to be moved to position the other printhead over the spittoon. This was a time-consuming and noisy process requiring several carriage movements. Thus, the service station 45 operates with a faster and quieter spitting routine than possible with the earlier designs. Moreover, the spittoon 48 takes no additional printer width as did the earlier spittoons, so the printer 20 has a smaller "footprint," that is, the printer takes up less workspace on the user's desk or other location where the printer is installed.

These three servicing routines, (1) at initial start-up, (2) during printing, and (3) before inactivity, are each advantageously accomplished without carriage motion, other than the motion required to bring the pens 50, 52 into the servicing region 44, or to exit from the servicing region. Many of the prior servicing routines required carriage motion to accomplish the various servicing functions, which generated excessive printer noise. Besides spitting, the earlier printers often required carriage motion to wipe and to cap the printheads. Carriage motion requires excessive time to allow the mass of carriage and pens to accelerate, decelerate, and change directions, for instance during multiple wiping strokes. The low mass of the translational pallet 120 is easily accelerated and decelerated for quick movement in both the fore and aft directions. Furthermore as mentioned above, less carriage motion also makes the system 100 quieter than the earlier printers.

Another significant advantage of the transitional servicing system 100 is its ability to be constructed in a "top down" assembly process. That is, the base 102 may be first secured in an assembly fixture, followed by insertion of the spit pad 300 in the bottom thereof. Next, the spindle pinion gear 115 is dropped down into bearing supports formed within the interior of the lower frame 102. After this, the pallet 120 may be inserted onto the upward supporting surfaces of tracks 130 formed along the interior side walls of the frame base 102. This may be done for instance, by first pressing the contact surfaces 136 of biasing arms 135 against the inboard side wall of base 102 to flex the arms 135, then sliding the outboard side of pallet 120 against the outboard side wall of base 102 into the track 130.

Preferably, the wiper mount 190 (with wipers and flaps already formed thereon) and the capping assembly 200 are first installed on the pallet 120, so the entire assembled pallet may be installed into the frame base 102 as a unit. It is also apparent that in some implementations, it may be more preferable to first install the pallet 120 alone into base 102, then to install the wiper mount 190, with wipers and flaps, and the capping assembly 200. As mentioned above, the wiper mount 190 has tabs 194 that slide over the hooks 198, which are then gripped by slots 196. The capping assembly 200 may be easily installed by first slipping the spring 270 around the rocker arm 275, and then attaching the rocker arm 275 to the sled post 280. The pair of sled mounting links or yokes 250 are then installed by inserting their pivot mounting points 256, 258 trough their respective pivot points 258, 260 defined by the side walls of the pallet 120. The cap sled 202 is then pushed down onto the upright arms 252, 254 of the links 250, and the base of the rocker arm 275 is positioned on top of the rocker support 276.

The final assembly steps are then accomplished by pressing the bonnet 110 on top of the frame base 102 using guides 108, until the snap hooks 106 engage. The bonnet 110 forms the upper portion of tracks 130 to secure the pallet 120 therein. Subsequent assembly steps may include the mounting of the transfer gears 108 and 109 to the exterior of the base 102, and then securing the drive motor 105 to the frame base 102 using clip 106 and fastener 107. Using the motor 105 to hold the gears 108 and 109 in place, not only decreases the overall part count for the service station 45, but it also speeds the assembly process, as does the use of clip 106, rather than using a separate screw or other fastener. This top-down assembly process is accomplished using fewer parts than other known service stations capable of servicing a pair of cartridges where one carries a pigment based ink and the other carries a dye based ink. The illustrated service station 100 is assembled in about half the time required by these other service stations, and requires about half the number of dedicated assembly stations. Thus, less labor cost is required to assemble service station 100, and the lower part count results in less direct material cost, yielding a more economical printer that still provides superior printhead servicing.

A further advantage of the translational servicing system 100 is the integration of the X, Y and Z alignment datums into the service station components at no additional cost for extra external references. The X axis alignment of the both the service station 100 and carriage 40 at adjacent locations minimizes variations and vastly improves the overall alignment scheme over that possible with the previous printers.

We claim:

1. A method of servicing an inkjet printhead of an inkjet printing mechanism, comprising the steps of:

moving the printhead along a scanning axis to a servicing position;

translationally moving a printhead servicing device in first and second planes that are each substantially perpendicular to the scanning axis, wherein said first and second planes are non-parallel to one another, to service the printhead when in the servicing position; and servicing the printhead with the servicing device after said moving step.

2. A method of servicing an inkjet printhead according to claim 1, wherein:

the printhead moving step is performed in a substantially horizontal plane; and the printhead servicing device moving step is performed in a substantially vertical plane.

3. A method of servicing an inkjet printhead according to claim 2, further comprising the step of providing the inkjet printhead with a bottom surface and the printhead servicing device with a top surface wherein the printhead servicing device top surface engages the inkjet printhead bottom surface when the inkjet printhead and the printhead servicing device are in the servicing position.

4. A method of servicing an inkjet printhead according to claim 3, further comprising the steps of:

providing a wiper mounted on the printhead servicing device; and providing a cap mounted on the printhead servicing device.

5. A service station for servicing an inkjet printhead which reciprocates along a scanning axis in an inkjet printing mechanism having a chassis, comprising:

a moveable platform supportable by the printing mechanism chassis for movement in first and second directions, the first and second directions being substantially perpendicular to the scanning axis and non-parallel to one another, from a servicing position to a rest position; and a printhead servicing member supported by the platform for selective movement between the rest position and the servicing position to service the printhead.

6. A service station according to claim 5, wherein:

the scanning axis is substantially horizontal; and the printhead servicing member moves in a plane that is substantially vertical when moving between the rest position and the servicing position.

7. A service station according to claim 6, wherein:

the inkjet printhead includes a bottom surface and the printhead servicing member includes a top surface; and the printhead servicing member top surface engages the inkjet printhead bottom surface when the inkjet printhead and the printhead servicing member are at the servicing position.

8. A service station according to claim 5, wherein:

a wiper is mounted on the printhead servicing member; and a cap is mounted on the printhead servicing member.

9. An inkjet printing mechanism, comprising:

a chassis;

an inkjet printhead supported by the chassis for motion along a scanning axis;

a translationally moveable platform supported by the chassis for translational movement along a first path substantially perpendicular to the scanning axis, and along a second path substantially perpendicular to the scanning axis and non-parallel to the first path, to a printhead servicing position; and a printhead servicing member supported by the platform to be selectively moved to the printhead servicing position to service the printhead.

10. An inkjet printing mechanism according to claim 9, wherein:

the scanning axis is substantially horizontal; and the printhead servicing member moves in a plane that is substantially vertical when moving to the printhead servicing position.

11. An inkjet printing mechanism according to claim 10, wherein:

the inkjet printhead includes a bottom surface and the printhead servicing member includes a top surface; and the printhead servicing member top surface engages the inkjet printhead bottom surface when the inkjet printhead and the printhead servicing member are at the servicing position.

12. An inkjet printing mechanism according to claim 9, wherein:

a wiper is mounted on the printhead servicing member; and a cap is mounted on the printhead servicing member.

13. An inkjet printing mechanism according to claim 9, further comprising:

a means for feeding a print media in a first direction; and a printzone where the inkjet printhead may be moved to along the scanning axis and disposed adjacent to the print media and the printhead servicing position.

14. An inkjet printing mechanism according to claim 13, wherein the print media is an envelope.

15. An inkjet printing mechanism, comprising:

means for feeding a print media in a first direction;

an inkjet printhead slideably mounted to the inkjet printer;

means operatively couples to the inkjet printhead for translating the inkjet printhead back and forth along a single second direction substantially perpendicular to the first direction between a print zone where the inkjet printhead is disposed adjacent to the print media and a cleaning position;

an inkjet service platform slideably mounted to the inkjet printer; and means operatively coupled to the inkjet service platform for translating the inkjet service platform back and forth in at least a third direction and a fourth direction defining respectively a first plane and a second plane, the first and second planes each being perpendicular to the single second direction and the first plane being parallel to the first direction so that the inkjet service platform engages the inkjet printhead at the cleaning position.

16. An inkjet printing mechanism according to claim 15 where the print media is an envelope.

17. An inkjet printing mechanism according to claim 15, wherein the inkjet printhead is translated to the cleaning position before the service platform is translated to the cleaning position to effect a maintenance operation.

18. An inkjet printing mechanism according to claim 15, wherein the first direction is substantially horizontal.

19. An inkjet printing mechanism according to claim 18, wherein the second plane is substantially vertical.

20. An inkjet printing mechanism according to claim 19, wherein the inkjet printhead includes a bottom surface and the inkjet service platform includes a top surface, and the inkjet service platform top surface engages the inkjet printhead bottom surface when the inkjet printhead and the inkjet service platform are at the cleaning position.

21. An inkjet printing mechanism according to claim 20, wherein the print media is an envelope.

22. An inkjet printing mechanism according to claim 15, wherein:

a wiper is mounted on the inkjet service platform; and a cap is mounted on the inkjet service platform.

23. A method of operating an inkjet printing mechanism comprising the steps of:

feeding a print media in a first direction;

translating an inkjet printhead back and forth in a single second direction perpendicular to the first direction;

translating the inkjet printhead along the single second direction between a print zone where the inkjet printhead is disposed adjacent to the print media and a cleaning position;

translating an inkjet service platform back and forth in at least a third direction that defines a plane, the plane being substantially perpendicular to the single second direction and parallel to the first direction; and translating the inkjet service platform in a fourth direction, wherein said fourth direction is substantially perpendicular to the single second direction and is non-parallel to the third direction, to engage the inkjet printhead at the cleaning position.

24. A method according to claim 23, wherein the print media being fed is an envelope.

25. A method according to claim 23, further comprising the steps of translating the inkjet printhead to the cleaning position and then translating the service platform to the cleaning position to effect a maintenance operation.

26. The method according to claim 25, further comprising the step of defining the first direction as substantially horizontal.

27. The method according to claim 26, further comprising the step of defining the fourth direction as substantially vertical.

28. The method according to claim 27, further comprising the steps of providing the inkjet printhead with a bottom surface and the inkjet service platform with a top surface wherein the inkjet service platform top surface engages the inkjet printhead bottom surface when the inkjet printhead and the inkjet service platform are at the cleaning position.

29. The method according to claim 28, wherein the print media being fed is an envelope.

30. A method according to claim 23, further comprising the steps of:

providing a wiper mounted on the inkjet service platform; and providing a cap mounted on the inkjet service platform.

* * * * *